US008209789B2

(12) United States Patent
Greenspon

(10) Patent No.: US 8,209,789 B2
(45) Date of Patent: Jul. 3, 2012

(54) QUICK-RELEASE STRUCTURE OF A TOILET COVER HINGE

(75) Inventor: Lawrence Greenspon, Chicago, IL (US)

(73) Assignee: LDR Industries Inc., Chicago, IL (US)

( * ) Notice: Subject to any disclaimer, the term of this patent is extended or adjusted under 35 U.S.C. 154(b) by 0 days.

(21) Appl. No.: 12/268,540

(22) Filed: Nov. 11, 2008

(65) Prior Publication Data

US 2011/0067170 A1 Mar. 24, 2011

(51) Int. Cl.
*A47K 13/12* (2006.01)

(52) U.S. Cl. ..... 4/240; 4/236; 4/234; 4/237

(58) Field of Classification Search ..... 4/234, 236, 4/237, 240; 411/372.5–373, 377; 292/DIG. 38; 16/365, 366, 371, 254, 270, 271, 272, 382
See application file for complete search history.

(56) References Cited

U.S. PATENT DOCUMENTS 188,402 A * 3/1877 Palm ..... 16/270
3,548,704 A * 12/1970 Kutryk ..... 411/373
3,709,538 A * 1/1973 Seitz et al. ..... 292/128
5,457,824 A * 10/1995 Reed ..... 4/234
6,826,803 B2 * 12/2004 Twomey ..... 16/387
7,155,748 B2 * 1/2007 Vierkant et al. ..... 4/240
D614,474 S * 4/2010 Edwards et al. ..... D8/326
2005/0217008 A1 * 10/2005 Vierkant et al. ..... 4/240
2006/0064808 A1 * 3/2006 Vierkant, III ..... 4/236

* cited by examiner

*Primary Examiner* — Gregory Huson
*Assistant Examiner* — Erin Deery
(74) *Attorney, Agent, or Firm* — Jackson IPG PLLC; Demian K. Jackson

(57) ABSTRACT

A quick-release structure of a toilet cover hinge includes a fixing bolt, a locking base, and a lid. To assemble, the present invention is coupled to a toilet cover. The fixing bolt is inserted into and engaged with a elongated engaging hole, and a stopping block is to press against the bolt head, which locks the toilet seat to the fixing bolt. To disassemble, the user places their fingers into arched notches of the locking base to pull the lid up and to disassemble the toilet cover for replacement or cleaning; the fixing bolt does not need to be unscrewed from the toilet bowl to remove the toilet seat. To reassemble, the locking base directly engages with the fixing bolt, which provides for a quick and convenient assembly and disassembly of the toilet seat.

2 Claims, 6 Drawing Sheets

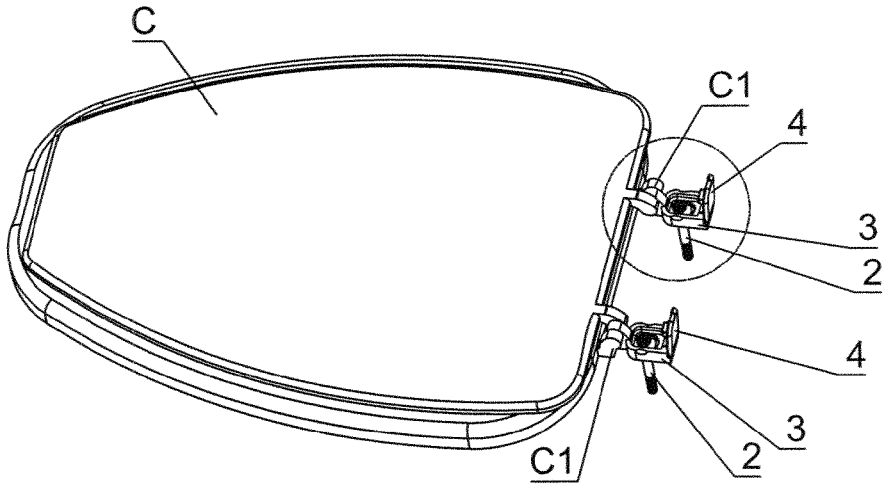
Fig. 2
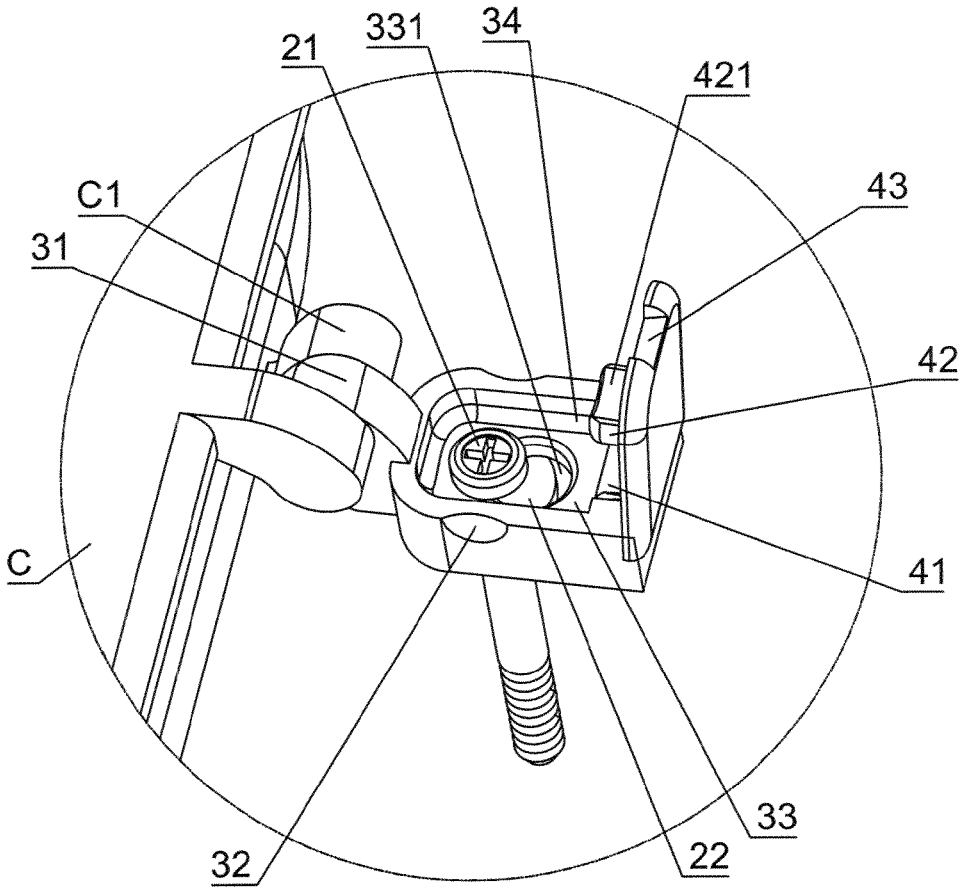
Fig. 2-A

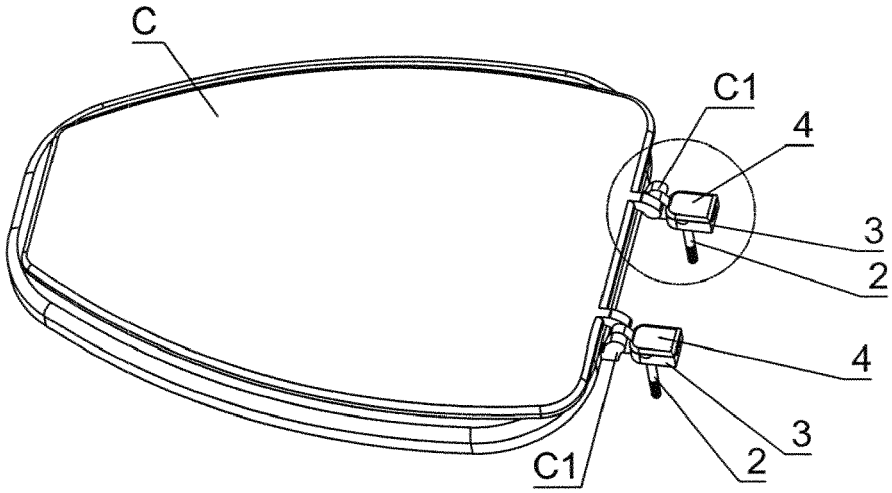
Fig. 3
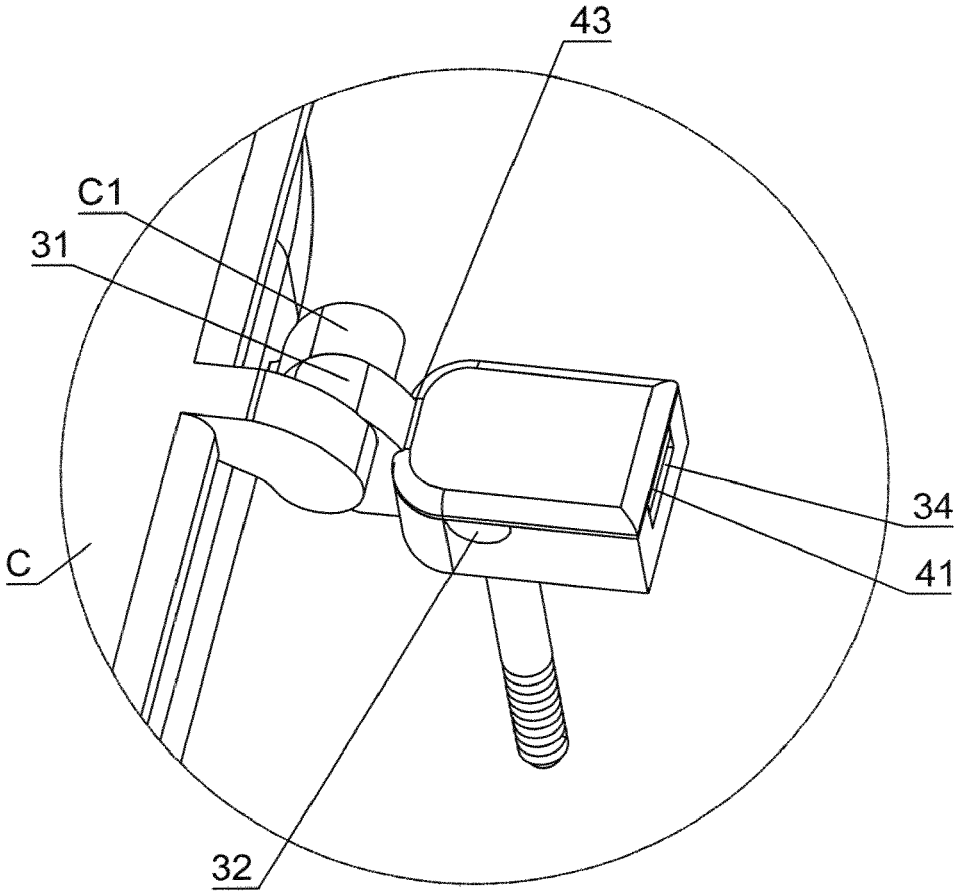
Fig. 3-A

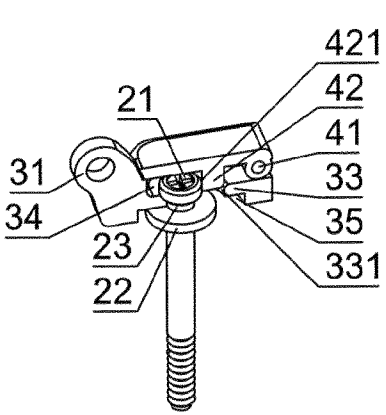
Fig. 5-D
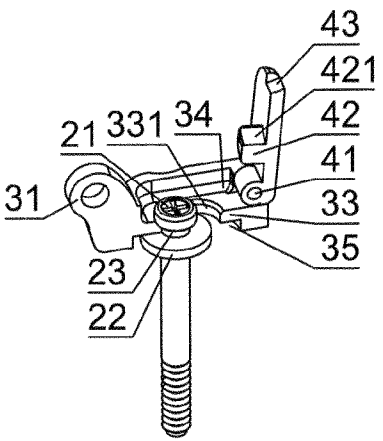
Fig. 5-C
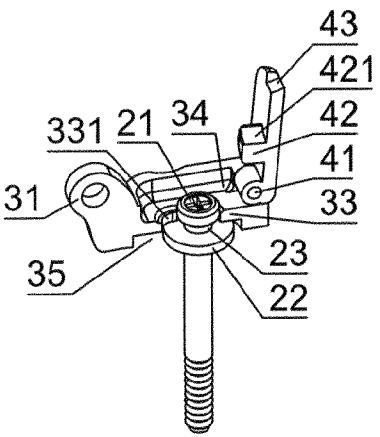
Fig. 5-B
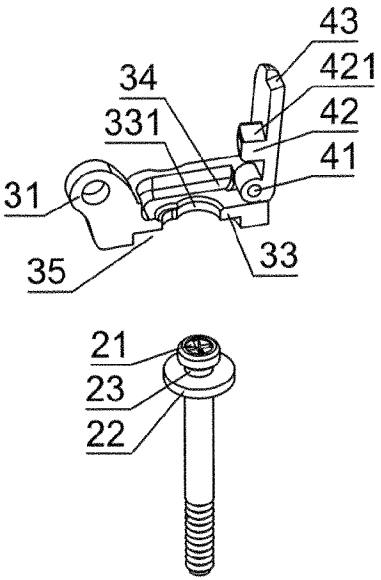
Fig. 5-A

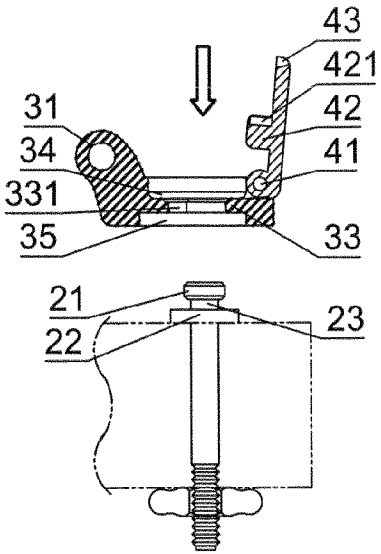
Fig. 6-A
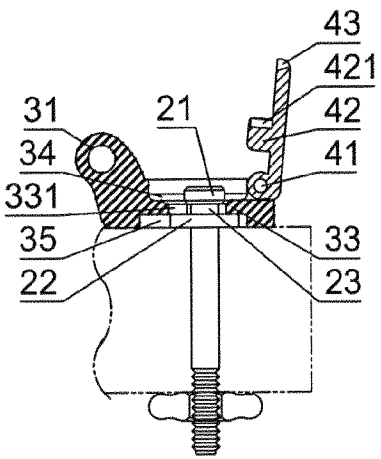
Fig. 6-B
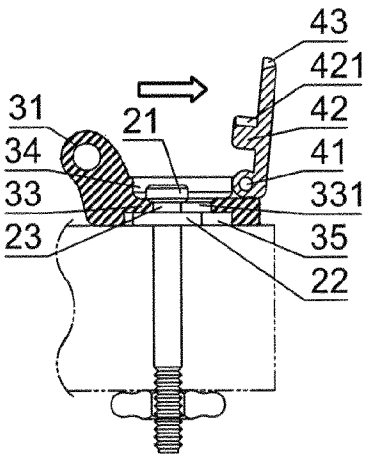
Fig. 6-C
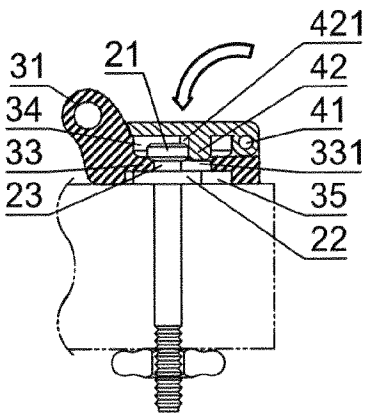
Fig. 6-D

QUICK-RELEASE STRUCTURE OF A TOILET COVER HINGE

BACKGROUND OF THE INVENTION

1. Field of the Invention

The present invention relates to a quick-release structure of a toilet cover hinge, and more particularly to one having a fixing bolt secured to the rearmost of a toilet seat. The fixing bolt has a neck for engaging with the smaller opening of a elongated engaging hole, a bolt head located in an accommodating trough and a stopper located in a sliding trough. A lid is adapted to cover a locking base, with a stopping block having a front surface to hold against the side of the bolt head to achieve a quick and easy assembly and disassembly.

2. Description of the Prior Art

A conventional toilet cover hinge contains an engaging board 5. The engaging board 5 has one end pivotally connected to a connecting shaft C1 of a toilet cover C and another end having engaging slots 51 for insertion of the bolt heads of two bolts. The bolts are inserted into bolt holes and secured to a toilet seat with nuts. The conventional toilet cover hinge has the following shortcomings:

1. Because the engaging board and the toilet cover are not connected fixedly, the user has to hold them steadily with both hands and then find out the right position. The engaging board and the toilet cover may block the user's sight to align the bolts and the bolt holes, which takes much time to assemble. Perhaps, the user has to bend down for better sight. This is not convenient in use.

2. It is not easy to clear the area where the toilet cover is connected to the hinge, except that the toilet cover is disassembled. The user has to bend down to unscrew the nuts when disassembly is required, which is laborious to clean and easy to be contaminated. After cleaning, it is necessary to screw the nuts again so as to secure the toilet cover.

Accordingly, the inventor of the present invention has devoted himself based on his many years of practical experiences to the development of a quick-release structure of a toilet cover hinge for a quick and easy assembly and disassembly.

SUMMARY OF THE INVENTION

According to the present invention, there is provided a quick-release structure of a toilet cover hinge, comprising of:

a fixing bolt, comprising a bolt head, a stopper underneath the bolt head, and a neck between the bolt head and the stopper;

a locking base, comprising a locking ring at a front end thereof, a pair of arched notches at the respective sides thereof, a partition having a elongated engaging hole at a central portion thereof for partitioning an upper accommodating trough and a lower sliding trough; and a lid, comprising of a pivot at a lower end thereof and a stopping block at a central section thereof.

BRIEF DESCRIPTION OF THE DRAWINGS

FIG. 2 is a perspective view of a preferred embodiment of present invention;

FIG. 2-A is an enlarged view of the preferred embodiment of the present invention;

FIG. 3 is another perspective view of the preferred embodiment of the present invention;

FIG. 3-A is another enlarged view of the preferred embodiment of the present invention;

FIG. 5-A is a perspective view of the preferred embodiment of the present invention in the first operating position;

FIG. 5-B is the perspective view of the preferred embodiment of the present invention in a second operating position;

FIG. 5-C is a perspective view of the preferred embodiment of the present invention in the third operating position;

FIG. 5-D is a perspective view of the preferred embodiment of the present invention in the fourth operating position;

FIG. 6-A is a cross-sectional view of the preferred embodiment of the present invention in the first operating position;

FIG. 6-B is a cross-sectional view of the preferred embodiment of the present invention in the second operating position;

FIG. 6-C is a cross-sectional view of the preferred embodiment of the present invention in the third operating position;

FIG. 6-D is a cross-sectional view of the preferred embodiment of the present invention in the fourth operating position;

DETAILED DESCRIPTION OF THE PREFERRED EMBODIMENTS

Figure 1:
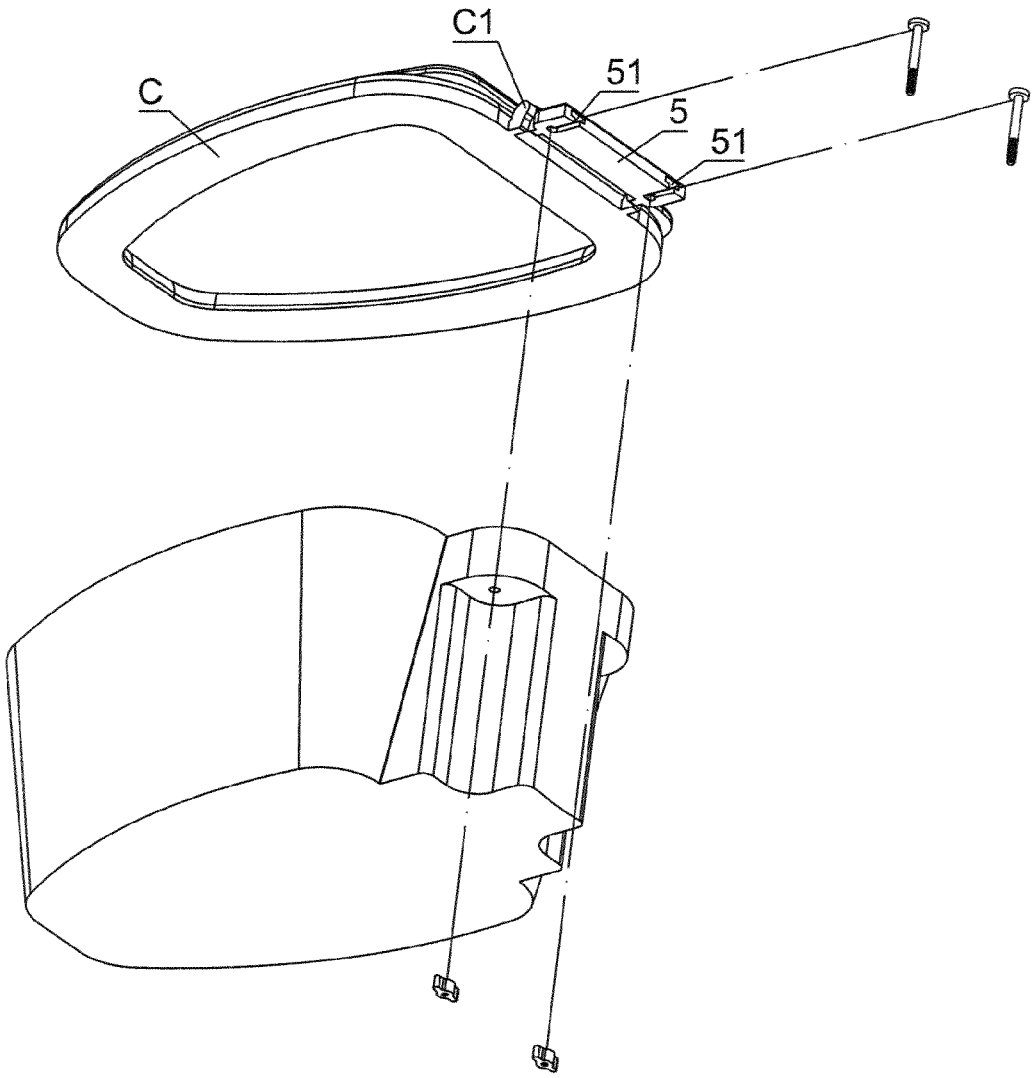
Fig. 1 (Prior Art)
FIG. 1 is an exploded view of the prior art.
Figure 4:
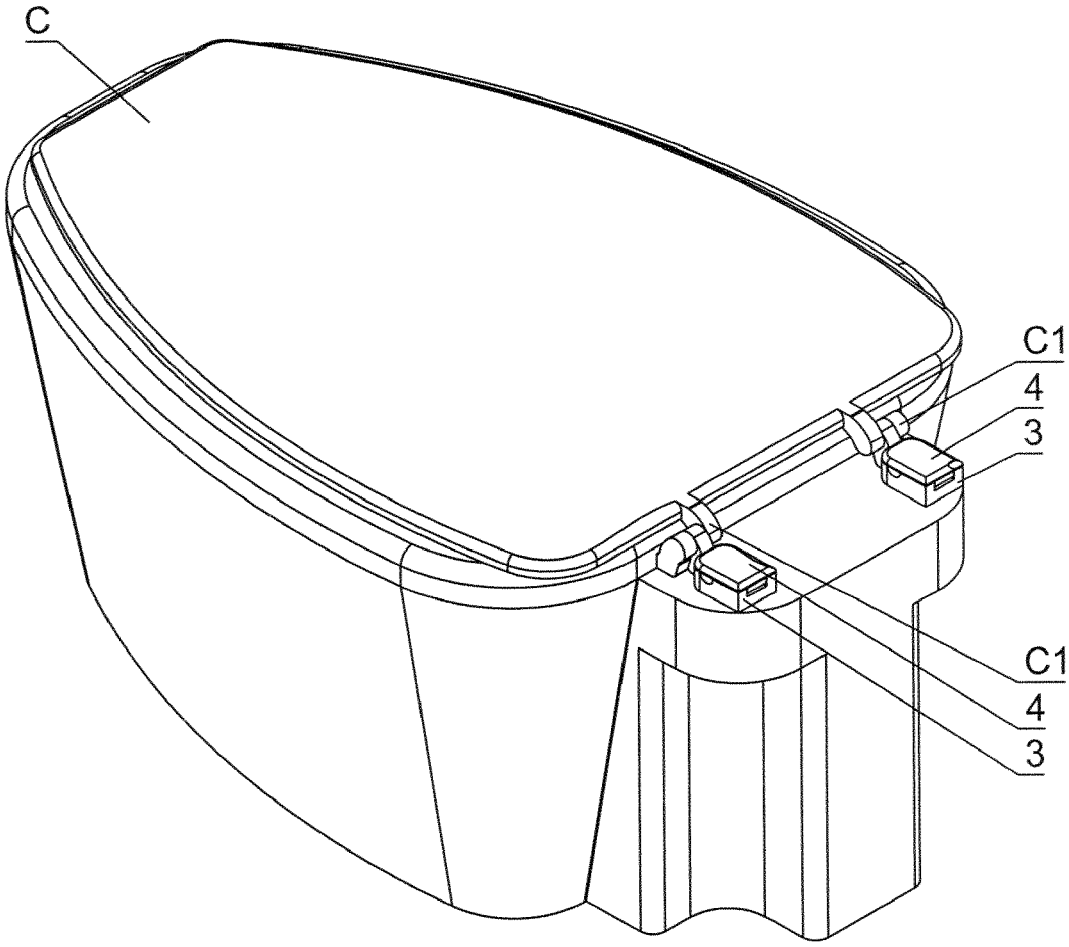
FIG. 4 is a perspective view of the preferred embodiment of the present invention coupled to a toilet cover.

Embodiments of the present invention will now be described, by way of example only, with reference to the accompanying drawings.

As shown in FIGS. 2, 2-A, 3, 3-A and 4, a quick-release structure of a toilet cover hinge according to a preferred embodiment of the present invention comprising of a fixing bolt 2, a locking base 3, and a lid 4.

The fixing bolt 2 comprises of a bolt head 21, a stopper 22 underneath the bolt head 21, and a neck 23 between the bolt head 21 and the stopper 22.

The locking base 3 comprises of a locking ring 31 at a front end thereof for connecting with a connecting shaft C1 of a toilet cover C, a pair of arched notches 32 at the respective sides thereof for insertion of a user's fingers, a partition 33 at a central portion 33 for partitioning an upper accommodating trough 34 and a lower sliding trough 35, and a calabash-shaped engaging hole 331.

The lid 4 comprises of a pivot 41 at a lower end thereof, a stopping block 42 at a central section thereof, and a recess 43 at a front end thereof. The pivot 41 is connected with an axle provided at a rear end of the accommodating trough 34 of the locking base 3. The stopping block 42 has a front surface 421 for holding against the side of the bolt head 21 of the fixing bolt 2 when the lid 4 is coupled to the locking base 3. The recess 43 is designed to correspond to the locking ring 31 of the locking base 3.

Referring to the FIG. 2 and FIGS. 5-A~D, the rear end of the locking base 3 is pivotally connected with the lid 4. The locking ring 31 of the locking base 3 is connected to the connecting shaft C1. The locking base 3 is above the fixing bolt 2, as shown in FIG. 5-A. The bolt head 21 is inserted through the larger opening of the calabash-shaped engaging hole 331. The bolt head 21 is located in the accommodating trough 34, while the stopper 22 is located in the sliding trough 35, as shown in FIG. 5-B. The fixing bolt 2 is moved transversely, with the neck 23 engaging with the smaller opening of the calabash-shaped engaging hole 331, as shown in FIG. 5-C. The lid 4 is pushed to cover the locking base 3, with the stopping block 42 inserting into the accommodating trough 34 and the front surface 421 holding against the side of the bolt head 21. The recess 43 engages with the edge of the locking ring 31, as shown in FIG. 5-D. The fixing bolt 2 is inserted into the toilet's bolt hole and secured, with the stopper 22 tightly attached to the toilet. This provides for a quick and definite engagement.

Referring to FIG. 2 and FIGS. 6-A~D, when it is necessary to replace or clean the toilet cover C, the operating procedures are reverse to the aforesaid and will be described hereinafter. The user places their fingers into the notches 32 and pulls the lid 4 upwards. The neck 23 of the fixing bolt 2 is retreated from the smaller opening to the larger opening of the calabash-shaped engaging hole 331. The locking base 3 is moved upwards to disengage from the bolt head 21, therefore, the toilet cover C is disassembled for replacement or cleaning. After replacement or cleaning, the toilet cover is reassembled with the aforesaid procedures, as shown in FIGS. 6-A~D. This provides for a quick and definite disassembly and reassembly of the toilet seat without having to remove the fixing bolt. Alternatively, the fixing bolt would need to be uninstalled and reinstalled to remove and replace the toilet seat.

What is claimed is:

1. A quick-release structure of a toilet cover hinge, comprising:

a fixing bolt comprising a bolt head, a stopper underneath the bolt head, and a neck between the bolt head and the stopper;

a locking base, comprising a locking ring at a front end thereof, a pair of arched notches at respective sides of the locking ring, and a partition having an elongated engaging hole with a larger opening at one end of the elongated engaging hole and a smaller opening at the opposite end and wherein the elongated engaging hole is arranged at a central portion of the locking base and wherein the central portion partitions an upper accommodating trough and a lower sliding trough such that the bolt head inserts through the larger opening such that the bolt head is in the accommodating trough and the stopper is located in the sliding trough and such that the fixing bolt moves transversely such that the neck engages with the smaller opening; and a lid, comprising a pivot at a lower end thereof and a stopping block at a central section thereof arranged to hold against a side of the bolt head when the lid is coupled to the locking base.

2. The quick-release structure of a toilet cover hinge as claimed in claim 1, wherein the lid further has a recess at a front end thereof, corresponding to the locking ring of the locking base.

* * * * *